US007814988B2

(12) United States Patent
Peter

(10) Patent No.: US 7,814,988 B2
(45) Date of Patent: Oct. 19, 2010

(54) SYSTEM AND METHOD FOR DETERMINING THE ROTATIONAL ALIGNMENT OF DRILLSTRING ELEMENTS

(75) Inventor: Andreas Peter, Celie (DE)

(73) Assignee: Baker Hughes Incorporated, Houston, TX (US)

( * ) Notice: Subject to any disclaimer, the term of this patent is extended or adjusted under 35 U.S.C. 154(b) by 151 days.

(21) Appl. No.: 11/971,752

(22) Filed: Jan. 9, 2008

(65) Prior Publication Data

US 2008/0164025 A1 Jul. 10, 2008

Related U.S. Application Data

(60) Provisional application No. 60/884,312, filed on Jan. 10, 2007.

(51) Int. Cl.
*E21B 47/09* (2006.01)

(52) U.S. Cl. ..... 175/45

(58) Field of Classification Search ..... 175/24, 175/26, 27, 45

See application file for complete search history.

(56) References Cited

U.S. PATENT DOCUMENTS

| | | | | |
|---|---|---|---|---|
| 5,259,466 | A | 11/1993 | Venditto et al. | |
| 6,698,534 | B2 | 3/2004 | Miszewski | |
| 6,843,320 | B2 | 1/2005 | Yarbro | |
| 6,896,056 | B2 | 5/2005 | Mendez et al. | |
| 6,938,689 | B2 | 9/2005 | Farrant et al. | |
| 2002/0078745 | A1 | 6/2002 | Russell | |
| 2004/0016571 | A1 | 1/2004 | Krueger | |
| 2008/0156531 | A1 * | 7/2008 | Boone et al. | 175/27 |
| 2008/0230273 | A1 * | 9/2008 | Brooks | 175/45 |
| 2009/0084536 | A1 * | 4/2009 | Kenison et al. | 166/66 |

FOREIGN PATENT DOCUMENTS

| | | |
|---|---|---|
| WO | WO9953172 | 10/1999 |
| WO | WO02082124 A1 | 10/2002 |

* cited by examiner

*Primary Examiner*—William P Neuder
(74) *Attorney, Agent, or Firm*—Mossman, Kumar & Tyler P.C.

(57) ABSTRACT

A rotational alignment system determines the angular relationship between two or more elements of a drill string using one or more sensors that detect one or more reference objects positioned on the drill string. A control unit determines the rotational or angular offset between two or more elements on the drill string using measurements made by the sensor(s). In one application, rotational offset values are used by a surface logging computer to correlate sensor data provided by a logging tool.

20 Claims, 3 Drawing Sheets

SYSTEM AND METHOD FOR DETERMINING THE ROTATIONAL ALIGNMENT OF DRILLSTRING ELEMENTS

CROSS REFERENCE TO RELATED APPLICATIONS

This application takes priority from U.S. Provisional Application Ser. No. 60/884,312 filed on Jan. 10, 2007.

BACKGROUND OF THE DISCLOSURE

1. Field of the Disclosure

This disclosure relates generally to systems, methods and devices for obtaining drilling assemblies that utilize an orientation sensing system.

2. Description of the Related Art

Valuable hydrocarbon deposits, such as those containing oil and gas, are often found in subterranean formations located thousands of feet below the surface of the Earth. To recover these hydrocarbon deposits, boreholes or wellbores are drilled by rotating a drill bit attached to a drilling assembly (also referred to herein as a "bottomhole assembly" or "BHA"). Such a drilling assembly is attached to the downhole end of a tubing or drill string made up of jointed rigid pipe or a flexible tubing coiled on a reel ("coiled tubing"). For directional drilling, the drilling assembly may use a steering unit to direct the drill bit along a desired wellbore trajectory.

Wellbore drilling systems may also use measurement-while-drilling (MWD) and logging-while-drilling (LWD) devices to determine wellbore parameters and operating conditions during drilling of a well. These parameters and conditions may include formation density, gamma radiation, resistivity, acoustic properties, porosity, and so forth. Many of these tools are directionally sensitive in that, to be meaningful, the measurements made by these tools should be correlated or indexed with a frame of reference for the formation. In one convention, the angular difference between a reference vector on a tool and a vector of reference is referred to as a toolface angle. The reference vector may be borehole highside or magnetic north. As is conventionally understood, the term "borehole highside" is an uppermost side of a non-vertical borehole. It is commonly desired to present the output from imaging sensors oriented with reference to the borehole highside.

The measurement of borehole highside may be made using devices such as a three-axis accelerometer positioned on the directionally-sensitive tool. Often, a drill string may include two or more directionally sensitive tools. While each such tool may include an orientation sensor, such an arrangement may be expensive and complex. A single sensor may be used for a plurality of directionally-sensitive tools if the angular alignment of these tools is known. Because wellbore tools are often assembled using threaded connections, a plurality of directionally-sensitive tools may not be rotationally aligned within acceptable tolerances. That is, for example, due to machining variations, two directionally-sensitive tools that are configured to point in the same direction could have an angular offset. Thus, conventionally, the angular or rotational offset between directionally sensitive tools are manually measured and recorded after these tools have been assembled. Manual measurement of rotational offsets or mismatches between two or more directionally-sensitive tools may be susceptible to errors and may be difficult in certain drilling conditions. For example, for offshore applications, rough seas may make manual measurement of rotational offsets difficult.

The present disclosure is directed to addressing one or more of the above stated drawbacks for determining the orientation of logging tools and other elements of a drilling system.

SUMMARY OF THE DISCLOSURE

In aspects, the present disclosure provides a rotational alignment system for determining the relative rotational position or angular relationship between two or more elements in a section of a work string conveyed into a wellbore. In one embodiment, the rotational alignment system includes one or more sensors that detect one or more reference objects positioned on the elements. Based on the measurements made by the sensor, a processor determines the rotational or angular offset between the two or more elements on the drill string. In one application, rotational offset values are determined for directionally-sensitive sensors in a logging tool. The determined rotational offset values are then used by a surface logging computer to properly correlate data provided by the logging tool. In one illustrative method, the sensor(s) of the rotational alignment system locate and characterize the reference objects by using optical or magnetic images of two or more reference objects positioned on the logging tool. The captured images are processed by the processor to determine the angular offsets between the reference objects. The determined offsets are then transmitted to and stored at the surface logging computer.

It should be understood that examples of the more illustrative features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE PREFERRED EMBODIMENT

Figure 1:
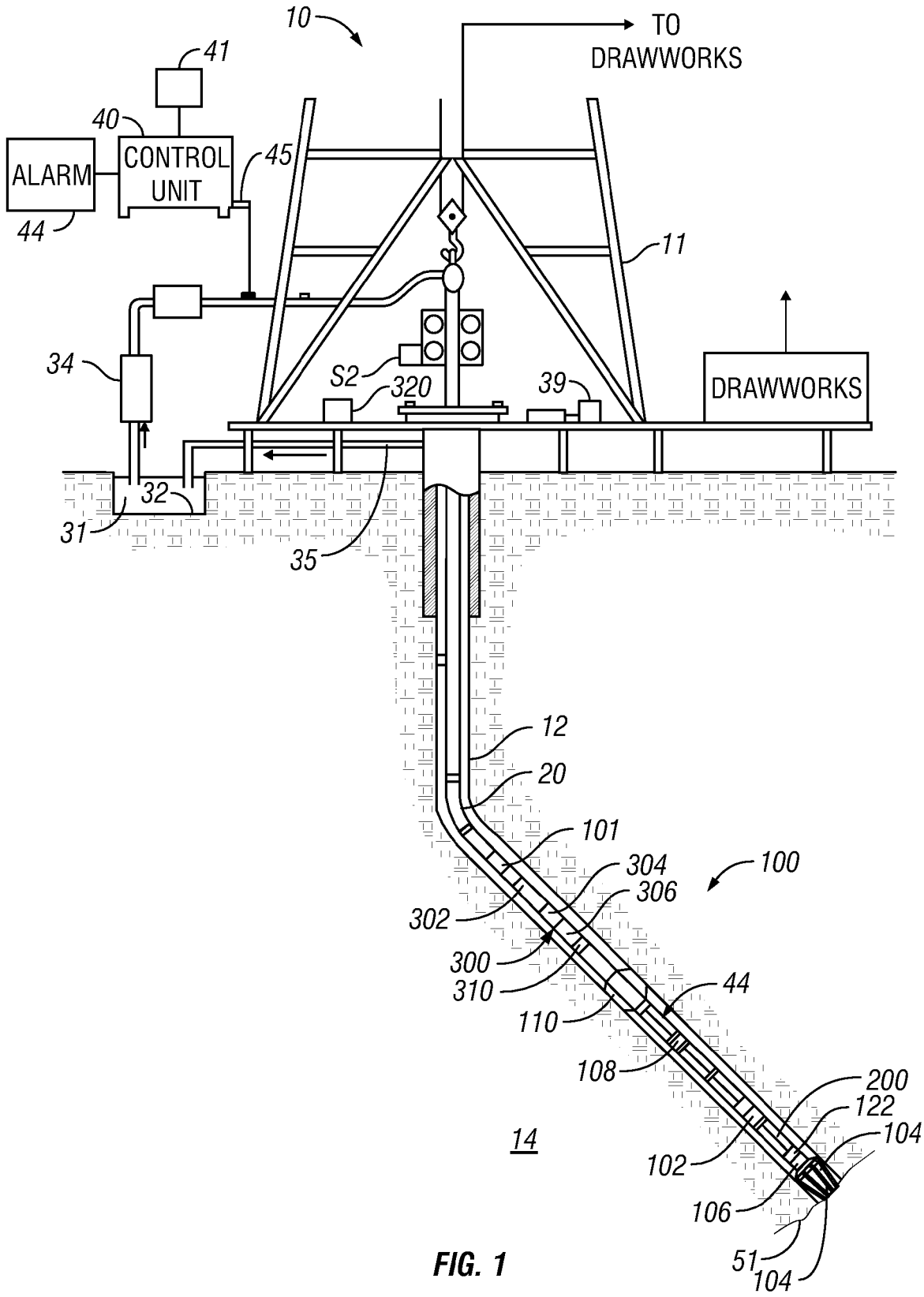
FIG. 1 shows a schematic diagram of a drilling system with a bottom hole assembly according to one embodiment of the present disclosure.

The present disclosure relates to devices and methods providing relative rotational position information for wellbore tools. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein.

Referring initially to FIG. 1 there is shown a schematic diagram of a drilling system 10 having a bottom hole assembly (BHA) or drilling assembly 100 conveyed via a tubing 101 into a borehole 12 formed in a formation 14. The terms "wellbore" and "borehole" may be used interchangeably herein. While a land well is shown, the present teachings are also applicable to offshore wells. For land based drilling, the drilling system 10 includes a conventional derrick 11. The tubing 101 may include jointed tubulars such as drill pipe or coiled tubing. The BHA 100 includes a drilling motor 102 for rotating a drill bit 104, a steering assembly 106 for steering the drill bit 104 in a selected direction, one or more BHA processors 108, one or more stabilizers 110, and other equipment known to those skilled in the art. The drill bit 104 may be rotated in any one of three modes: rotation by only the tubing 101, rotation by only the drilling motor 102, and rotation by a combined use of the tubing 101, and drilling motor 102. The drilling system 10 includes surface and/or downhole processors to control BHA 100 operation. In one embodiment, the drilling system 10 includes a control unit 40 and one or more BHA processors 44 that cooperate to analyze sensor data and execute programmed instructions to achieve more effective drilling of the wellbore. The control unit 40 and BHA processor 44 receives signals from one or more sensors and process such signals according to programmed instructions provided to each of the respective processors. The surface control unit 40 displays desired drilling parameters and other information on a display/monitor 41 that is utilized by an operator to control the drilling operations. The surface control unit 40 and the downhole processor 44 may contains digital data processing circuitry, memory for storing data, recorder for recording data and other known peripherals.

The drilling system also includes a bi-directional communication link 39 and surface sensors, collectively referred to with $S_2$. The communication link 39 enables two-way communication between the surface and the drilling assembly 100. The communication link 39 may be mud pulse telemetry, acoustic telemetry, electromagnetic telemetry or other suitable communication system. The surface sensors $S_2$ include sensors that provide information relating to surface system parameters such as fluid flow rate, torque and the rotational speed of the drill string 20, tubing injection speed, and hook load of the drill string 20. The surface sensors $S_2$ are suitably positioned on surface equipment to detect such information. These sensors generate signals representative of its corresponding parameter, which signals are transmitted to a processor by hard wire, magnetic or acoustic coupling. The sensors generally described above are known in the art and therefore are not described in further detail.

It should be understood that FIG. 1 illustrates only an exemplary non-limiting drilling system to which the present teachings may be applied. Other systems, for example, may be a rotary steerable systems that do not require downhole motors. Still other embodiments could utilize downhole tractors or thrusters. Exemplary suitable drilling systems include, but are not limited to, AUTOTRAK and VERTITRAK systems available from Baker Hughes Incorporated.

Figure 2:
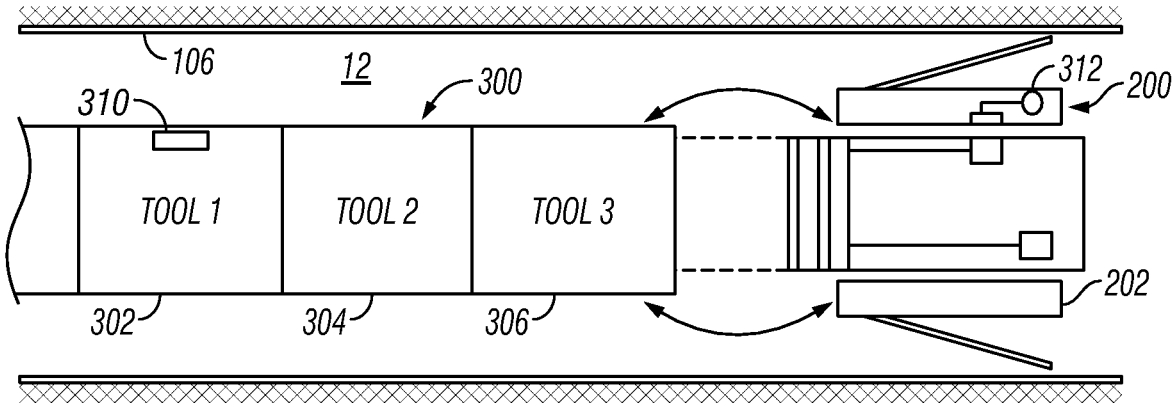
FIG. 2 shows a sectional schematic view of a logging tool used in accordance with one embodiment of the present disclosure.
Figure 3:
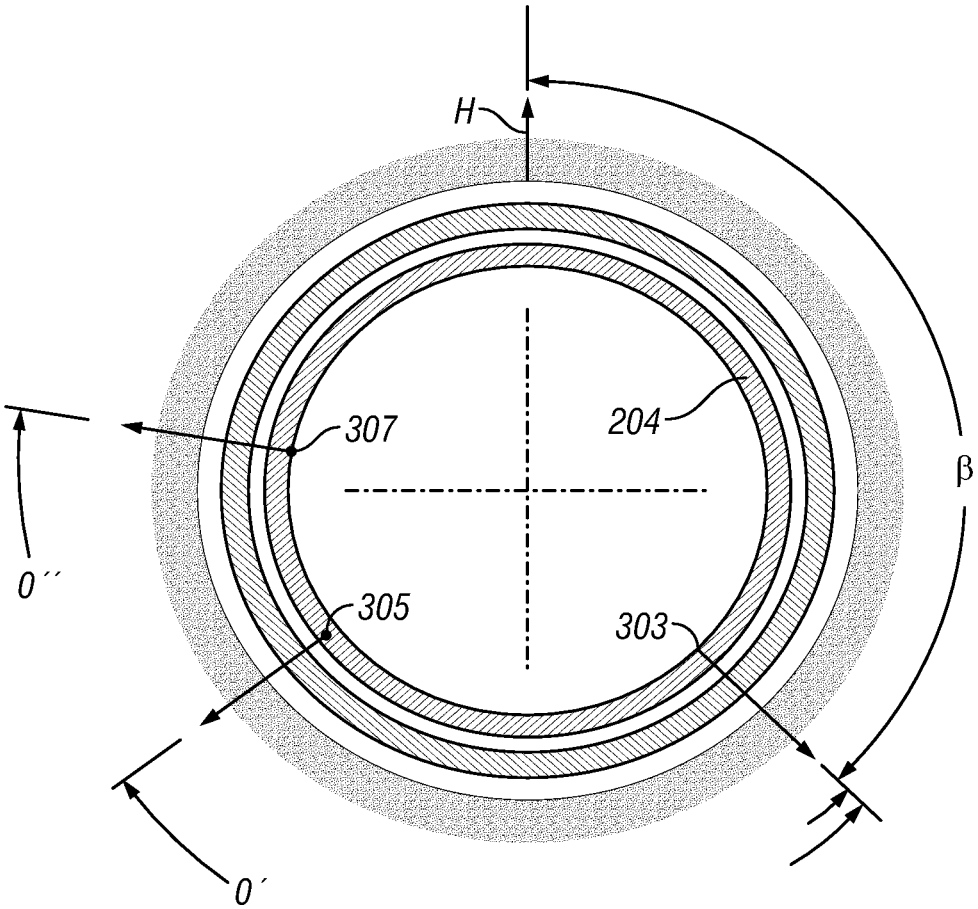
FIG. 3 illustrates the relationships of the measured angular offsets in accordance with one embodiment of the present disclosure.

Referring now to FIGS. 1 and 2, the BHA 100 also includes a logging tool 300, which may include a suite of tool modules 302, 304, 306, that obtain information relating to the geological, geophysical and/or petrophysical characteristics of the formation 14 being drilled. Referring now to FIG. 2, there is schematically illustrated a section of a representative logging tool 300. The logging tool 300 is shown as including three separate tool modules 302, 304, 306. The tool modules 302, 304, 306 may be positioned on a rotating or non-rotating section of the tubing 101. Exemplary tool modules 302, 304, 306 of the logging tool 300 may measure parameters of interest such as gamma rays, resistivity, density, acoustic properties, and porosity. Other exemplary tools along the drill string may include radiation tools, tools for induction logs, ultra sonic calipers, and nuclear magnetic resonance tools (NMR). As is known, one or more of these tool modules may be directionally sensitive. That is, the direction a tool module is pointing when taking a measurement must be known to make full use of the measurements. In one convention, the angular position of the tool module relative to a reference frame, such as borehole highside, is defined as a "tool face" of a tool module. For example, using the sensor's sensitive axis as the reference point, the measurements of a tool module may be correlated with a selected formation reference point such as borehole "highside," e.g., a measurement's tool face may be reported as ninety degrees from highside. Referring now to FIG. 3, there is shown a cross-section of the FIG. 2 embodiment, wherein the tool module 302 has a tool face 303, the tool module 304 has a tool face 305, and the tool module 306 has a tool face 307. The high side of the wellbore 106 is labeled with the reference label H. In one embodiment, an orientation sensor 310 is positioned on one of the tool modules 302, 304, or 306 to determine the tool face angle of the underlying tool module. For example, the orientation sensor 310 is a three-axis accelerometer positioned on the tool module 302 to determine a tool face angle β. In another embodiment, an orientation sensor 312 may be positioned on another device such as a non-rotating section 202 of a steering device 200. Such arrangements are discussed in co-pending and commonly assigned U.S. patent application titled "Instantaneous Measurement Of Drill string Orientation," and bearing application Ser. No. 11/854,409 filed Sep. 12, 2007 which is hereby incorporated by reference for all purposes.

As seen in FIG. 3, the tool faces 303, 305 and 307 all point in different directions. Thus, the angular offset 0' and 0" of the tool face 305 and 307 relative to the tool face 303 must be known in order to determine the tool face angles of the adjacent modules 304 and 306. As will be described in greater detail below, embodiments of the present disclosure enable the determination of the tool face angle of one or more tool modules adjacent to tool module 302 by first determining the relative angular offset between tool module 302 and the adjacent tool modules. During operation, determined angular offsets are summed with the measured tool face angle β of tool module 302 to determine the actual tool face angle of the adjacent tool modules 304 and 306. Thus, due to the fixed angular relationship of the tool modules, determining a tool face angle of one tool module enables the determination of the tool face angle of any tool module fixed to that tool module.

Figure 4:
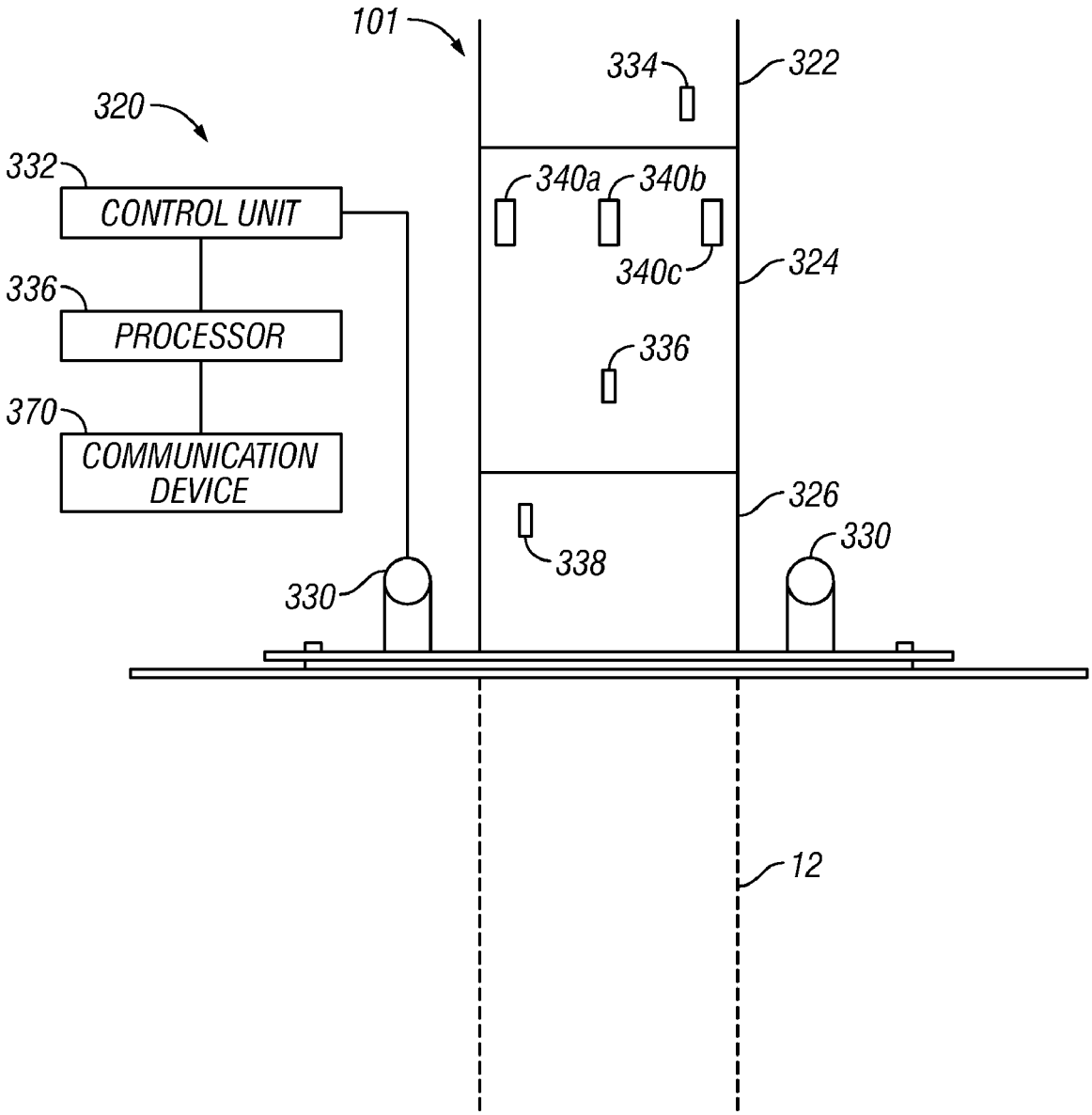
FIG. 4 is a sectional schematic view of one rotational alignment system made in accordance with one embodiment of the present disclosure.

Referring now to FIGS. 1 and 4, to determine the relative angular offset of the tool modules in the logging tool 300, the drilling system 10 uses a rotational alignment tool 320. As described previously, there may be an angular mismatch between the tool faces 303, 305, 307 that arise during make-up or assembly of the tool 300. Described below are embodiments of methods and devices for precisely determining the angular differences between the tool faces of the modules 302, 304 and 306, which then enables a correlation of their measurements with "borehole highside" or some other frame of reference.

Referring now to FIG. 4, there is shown one embodiment a rotational alignment system 320 for determining the angular relationship between two or more elements of a portion of a drill string 101. For ease of discussion, such elements are shown as elements 322, 324 and 326. These elements may be tool modules or some other component of the drill string or BHA. Further, these elements may also be components of a tool conveyed into the wellbore via a wire line or slickline. The rotational alignment system 320 includes one or more sensors 330 and a control unit 332. The control unit 332 and the sensors 330 may communicate through a wire or a wireless transmission device (e.g., RF, IR). Moreover, the sensors 330 may be powered using on-board batteries or an external power source. The sensor 330 and control unit 332 cooperate to detect one or more reference objects 334, 336, 338 that are located at a predetermined angular location on the elements 322, 324 and 326, respectively. Generally speaking, the terms "reference object," "reference marker," or "alignment marker" as used herein refers to any element or device that may be detected by the sensor 330. Based on the measurements made by the sensor 330, the control unit 332 determines one or more rotational offset values and transmits the value(s) to an external device. For instance, the external device may be a processor 336 configured to operate as a surface logging computer. The processor 336 uses the determined rotational offset values to correlate sensor data eventually provided by the logging tool 300 (FIG. 1) with a selected frame of reference. In another arrangement, the control unit 322 may include a processor that is programmed to determine the rotational offset values and transmit these values to a surface logging computer. In still another arrangement, the control unit 322 may transmit unprocessed sensor data to the surface logging computer, which is programmed to determine the rotational offset values from the received unprocessed sensor data.

A number of methodologies may be employed to determine the relative angular relationships of the tool faces of the elements 322, 224 and 326. A few non-limiting examples are described below.

In one embodiment, the sensor includes an optical camera that captures images of the elements 322, 324 and 326 as these elements are being conveyed into the wellbore 12. The images may be in analog or digital form. The control unit 332 analyzes the images to determine the relative angular positions of the reference objects 334, 336, 338. For instance, upon analyzing the captured images, the control unit 332 could determine that reference objects 334 and 336 have a forty degree angular separation and reference objects 334 and 338 have a fifty degree angular separation. Thus, upon determining the tool face of reference object 334, the tool face of reference objects 336 and 338 may be readily calculated. The camera may utilize visible light or infrared radiation. Moreover, in certain analysis embodiments, the images captured by the sensor may be compared against a reference or baseline image that has been previously stored in the control unit 332.

In another embodiment, the sensor may include a magnetic field sensor to detect the reference objects 334, 336, 338. For example, the reference object 334 could cause a discernable change in the local magnetic field of the drill string. The sensor detects the magnetic field anomaly and the control unit 322 processes the sensor measurements to determine the angular position of the reference object 334.

While two sensors are shown, it should be appreciated that more or fewer sensors may be used to detect the reference objects 334, 336 and 338. For example, a plurality of sensors may be circumferentially arrayed around the drill string. Likewise, while a single reference object is shown at each axially spaced apart location, a plurality of reference objects 340*a,b,c* may be circumferentially arrayed around a section of the tubing 101. An exemplar arrangement could include a plurality of uniquely identifiable reference objects, each having a different and known fixed angular orientation with the tool face of the underlying tool module.

The reference objects may be active or passive. A passive object may be a discontinuity on an outer surface of the element 322. The discontinuity may be a physical discontinuity such as gap or raised portion, a discontinuity in a magnetic field, or a change in color. An active object may include a device that emits a signal detectable by the sensor 330. The signal may be an optical, acoustic, electromagnetic or other type of discernable signal. The reference object may be integral or formed on the drill string or attached to the drill string. Moreover, the reference object may be a pre-existing feature on the drill string and not necessarily a feature added to the drill string for the sole purpose of determination angular relationships. The reference objects may be all the same or have unique identifying characteristic. For instance, the reference object 336 could have a shape or emit a signal that allows unique identification by the control unit 322. Suitably configured RFID transponder tags are one non-limiting example of an active reference object.

It should be understood that the processing performed by the processor 322 may be extensive or minimal depending on the nature of the data received from the sensor. In some arrangements, the processor 322 may include pre-programmed instructions that analyze the measured data to determine an angular position. In other arrangements, the sensor may transmit a signal only when there is a predetermined relationship between the sensor 322 and the reference object; e.g., a signal may be transmitted when the sensor 322 is aligned with the reference object. In such an arrangement, analysis of the signal itself is not necessarily required to determine the angular position of the reference object.

Although FIG. 2 shows a rotational alignment apparatus operating while drill string is being conveyed into the wellbore, in other embodiments, the rotational alignment system 320 may be deployed at a location on the rig where the drill string is being made-up. Also, the rotational alignment system 320 may be configured as portable device. For example, a human operator may carry the sensor 330 and scan a section of a made-up drill string (e.g., a stand). The measurements made by the sensor 330 may be either stored for later retrieval or wirelessly transmitted to the control unit 332, the processor 336 or some other external device.

An exemplary mode of operation of the rotational alignment system 320 will now be discussed with reference to FIGS. 1-4. As the tubing 101 is conveyed into the wellbore 12, the sensor(s) 330 of the rotational alignment system 320 are operated to locate and characterize the reference objects, e.g., reference markers 336 and 338. For instance, an optical sensor could capture images of the joints between elements 334 and 336 and elements 336 and 338. The captured images are processed by the control unit 332 to determine the angular offsets between markers 334, 336 and 338. The determined offsets are then transmitted to and stored at the surface logging computer 336. In some embodiments, the determined offset may also be transmitted to another device via a communication device 370. For example, the determined angular offset value may be transmitted to the BHA processor 44.

During drilling or as the drill string is being tripped into or out of the wellbore 12, the logging tool 300 measures various parameters of interest relating to the formation. The orientation measurement sensor 310 periodically and/or continuously determines the tool face of the tool module 302 relative to highside or other selected reference frame for the tool module 302. Because modules 304 and 306 have a fixed relationship with the module 302, the tool faces of these two modules may also be determined by using the surface-determined angular offset between module 304 and modules 306 and 308. In one arrangement, the BHA processor 44 uses the determined angular offset value to correlate the measurements of the modules 304 and 306 with borehole highside. In other arrangement, the surface logging computer 336 at the surface uses the determined angular offset value to correlate the measurements of the modules 304 and 306 with borehole highside.

Although logging tools are discussed, any element making up a string, whether drill string or coiled tubing, could be analyzed (e.g., subs, collars, steering units, etc.). Also, as noted previously, embodiments of the present disclosure may also be used in conjunction with wireline or slickline conveyed devices.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. An apparatus for determining a relative rotational position of two or more wellbore tool elements having a fixed angular relationship, comprising:

at least one sensor sensing a section of the wellbore tool having the two or more elements and generating a responsive signal; and a processor configured to receive the responsive signal from the at least one sensor and determine the relative rotational position of the two or more elements using the responsive signal.

2. The apparatus of claim 1 wherein the at least one sensor is one of: (i) an optical sensor, (ii) an infrared sensor and (iii) a magnetic field sensor.

3. The apparatus of claim 1 wherein the at least one sensor is positioned at a surface location the processor is a general purpose computer.

4. The apparatus of claim 1 wherein the responsive signal includes an image of at least the section of the wellbore tool.

5. The apparatus of claim 1 further comprising a surface logging computer configured to receive the determined relative rotational position from the processor.

6. The apparatus of claim 1 further comprising a transmitter transmitting the responsive signal from the at least one sensor to the processor using one of (i) a wire, and (ii) a wireless transmission device.

7. The apparatus of claim 1 further comprising at least one reference object positioned on the well bore tool.

8. The apparatus of claim 7 wherein the at least one reference object is a discontinuity on a surface of the wellbore tool.

9. The apparatus of claim 8 wherein the discontinuity is one of: (i) a depression, (ii) a raised portion, and (iii) a magnetic signal.

10. A method for determining a relative rotational position of two or more wellbore tool elements having a fixed angular relationship, comprising:

sensing a section of the wellbore tool having the two or more elements with at least one sensor;

generating a signal in response to the sensed section of the wellbore tool; and determining the relative rotational position of the two or more elements using the responsive signal using a processor.

11. The method of claim 10 wherein the at least one sensor is one of: (i) optical sensor, (ii) an infrared sensor and (iii) a magnetic field sensor.

12. The method of claim 10 wherein the sensing is done at the surface and the processor is a general purpose computer.

13. The method of claim 10 wherein generating the signal includes imaging at least the section of the wellbore tool.

14. The method of claim 10 further comprising transmitting the determined relative rotational position from the processor to a surface logging computer.

15. The method of claim 14 further comprising:

measuring a parameter of interest in the wellbore;

determining a wellbore highside in the wellbore; and correlating the measured parameter of interest with wellbore highside using the surface logging computer.

16. The method of claim 10 further comprising positioning at least one reference object on the well bore tool.

17. The method of claim 16 further comprising detecting the at least one reference object using the at least one sensor.

18. A system for determining a relative rotational position of two or more wellbore tool elements having a fixed angular relationship of a wellbore tool, comprising:

a rig at a surface location configured to convey the wellbore tool into a wellbore;

at least one sensor positioned on the rig, the at least one sensor configured to sense a section of the wellbore tool having the two or more elements and generate a responsive signal; and a processor configured to receive the responsive signal from the at least one sensor and determine the relative rotational position of the two or more elements using the responsive signal.

19. The system of claim 18 further comprising a surface logging computer configured to receive the determined relative rotational position from the processor.

20. The system of claim 19 further comprising:

at least one logging tool in the wellbore tool, the at least one logging tool being configured to measure at least one parameter of interest; and an orientation measurement sensor in the wellbore tool, the orientation measurement sensor being configured to determine a wellbore highside;

wherein the surface logging computer is further configured to correlate the measured parameter of interest with wellbore highside.

* * * * *